US005107654A

United States Patent [19]

Leonardis

[11] Patent Number: 5,107,654

[45] Date of Patent: Apr. 28, 1992

[54] FOUNDATION REINFORCEMENT CHAIRS

[76] Inventor: Nicola Leonardis, 23 Mayfred Avenue, Hope Valley, SA 5090, Australia

[21] Appl. No.: 417,779

[22] Filed: Oct. 6, 1989

[30] Foreign Application Priority Data

Oct. 7, 1988 [AU] Australia ..... PJ0824

[51] Int. Cl.[5] ..... E04C 5/16

[52] U.S. Cl. ..... 52/685; 52/686; 52/677

[58] Field of Search ..... 52/677, 685, 686, 576, 52/577, 684, 687, 719, 323

[56] References Cited

U.S. PATENT DOCUMENTS

| | | | |
|---|---|---|---|
| 1,070,921 | 8/1913 | Saltiel | 52/686 |
| 2,916,909 | 12/1959 | Miller | 52/323 |
| 3,255,565 | 6/1966 | Menzel | 52/687 X |
| 3,623,289 | 11/1971 | Lowery | 52/677 |
| 3,673,753 | 7/1972 | Anderson | 52/685 |
| 3,693,310 | 9/1972 | Middleton | 52/685 |
| 4,655,023 | 4/1987 | Yung | 52/685 |
| 4,788,809 | 12/1988 | Koukourou | 52/577 X |
| 4,831,803 | 5/1989 | Leonardis | 52/577 X |
| 4,835,933 | 6/1989 | Yung | 52/685 |

FOREIGN PATENT DOCUMENTS

| | | | |
|---|---|---|---|
| 407773 | 2/1966 | Australia | 52/686 |
| 863601 | 2/1971 | Canada | 52/686 |
| 586815 | 4/1977 | Fed. Rep. of Germany | 52/677 |
| 260104 | 9/1988 | Fed. Rep. of Germany | 52/677 |
| 1420975 | 11/1965 | France | 52/677 |
| 2006314 | 5/1979 | United Kingdom | 52/685 |

*Primary Examiner*—John E. Murtagh
*Assistant Examiner*—Robert Canfield
*Attorney, Agent, or Firm*—Oldham & Oldham Co.

[57] ABSTRACT

A support chair for supporting reinforcement for foundations in which there is a turret shape and a lower base, the turret shape having a plurality of upwardly open slots into which the reinforced rods may be located the shape of each of the slots being such as to provide for interlocking of each rod particularly by providing a narrower part of the slot through which the rod must squeeze to a lower wider part.

17 Claims, 8 Drawing Sheets

FOUNDATION REINFORCEMENT CHAIRS

BACKGROUND OF THE INVENTION

This invention relates to support chairs for foundations and, in particular, where a foundation includes an uppermost slab part of which is supported on lost formwork.

In particular, there is a difficulty associated with lost formwork in which the formwork is comprised of a disposable material such as corrugated cardboard.

While such material is effective from a cost point of view, there can, nonetheless, be some disadvantages insofar that if the lost formwork is in the form of rectangularly shaped boxes with an uppermost surface which is substantially horizontal, there can be difficulties if substantial loads are applied during pouring of the concrete.

One particular problem occurs insofar that reinforcement fabric in either the form of mesh or single rods need to be supported a given distance above a lowermost surface and this is achieved by supporting the mesh of rods by means of a plurality of support chairs.

Each chair, in a conventional system, includes an uppermost open slot and a lowermost planar surface by which the chair rests on a supporting surface being the lost form work.

Such devices, as presently exist, have not been found to be especially useful in that when a heavy load is pulled across the fabric, these will tend to shift the fabric and depress the top of the box so that the chairs will separate from a supporting position losing any relative relationship in position with the result that the fabric can be left without support and fall to a lowermost level or it requires a very significant time for a worker to relocate these on an ongoing basis.

SUMMARY OF THE INVENTION

According to this invention then, there is proposed a support chair which includes at least one uppermost open slot and a horizontal support base, characterised in that at least one of the upwardly open slots in the support chair has an uppermost open part which is adapted to interengage with a gripping effect reinforcement fabric rods. The result of this arrangement is to ensure that each chair is then more likely to stay interlocked with the fabric so that with any temporary diversion of the fabric or lowering of the top supporting surface of a box surface, the chair will stay with the fabric and will not allow this to, at any time, be lower than the separation distance as determined by the chair.

In preference, a chair includes an uppermost turret like part which includes upwardly open slots within a wall defining the turret shape and each of the slots being commonly characterised in having a narrower uppermost part with at least inwardly diverging walls from an uppermost end to the narrowest gap and outwardly diverging walls below the narrowest gap.

In preference, there are at least two sets of such slots each diametrically arranged a first set orthogonally aligned to a second set of slots and providing support for fabric at a first selected height, and the second set located so as to support fabric which is extending transversely to the support direction of the first said slots, and arranged to provide support at a second selected height.

Accordingly, and very typically then, there can be, in one orientation of the chair, support for fabric that is steel rods at say 45 mm height above a base and, in another case, with 90 degrees rotation, support for the fabric at 35 mm height.

While reference has been made in the very simplest form to providing a slot having a shape which includes a gap which is narrower at an upper part of the slot then the gap defined between the walls of a lower part of the slot. It is also envisaged that many other techniques can be used including an outwardly extending finger which will provide for an interlocking of any fabric pushed into the slot shape restricting, thereby, any release of the fabric from this.

In a further form, the interlocking or interengaging shape can be achieved by having, within the walls defining the slot shape, a slightly downwardly extending finger which extends across the narrowest part of the gap but which is readily easily diverted at least in a downward position for insertion of a fabric rod into the underneath slot area.

However, the shape of the finger is such that if the rod is brought upwardly, this will cause the finger to rotate from its formally slightly downwardly extending position to a more horizontal position whereby to effect a substantial blocking of the rod thereby.

This then indicates a typical arrangement.

One feature of any chair used in the situation described is that with corrugated cardboard, this can become vulnerable to localised pressure points causing a substantial depression in such an area.

This can come about, for instance, where the boxes are set out overnight and are subjected to rain or dew prior to being needed in a pouring situation.

To this end, there is proposed that any chair shall have a substantial base and that this be extensive and fully across any uppermost area and of a substantially planar underneath surface shape.

The invention, accordingly, can reside in a chair so characterised or it can reside in the assembly of a chair supporting fabric above a lost formwork arrangement or it can reside in the method of locating fabric above a lost formwork system which includes the steps of locating fabric through an upwardly open aperture such that there is an interlocking relationship between the fabric and the slots whereby the chair will have a positively interlocking relationship with the fabric.

Reference has been made to lost formwork and it is envisaged that such lost formwork is in the form of pods or boxes which are manufactured from cardboard and, in preference, corrugated cardboard sheets these being folded in such a way as to form four sides, a top and a bottom, and there being a plurality of vertically aligned spacers in honeycomb fashion extending between the uppermost and lowermost surfaces of the box shape.

There can be one, two or three thicknesses of cardboard on the uppermost surface to assist in reducing localised depression under some stressed loads but, of course, the shape of the chair also assists in reducing such depression.

The support chairs, in preference, are manufactured by being integrally moulded from plastics material and include separately spaced apart legs supporting the turret section with respect to the base.

One difficulty with existing chairs is that when they are pulled sideways, for instance, when an operator steps on mesh causing the mesh to be distorted, this can cause an offsetting inclination to adjacent chairs and there is difficulty if the lost formwork comprises cardboard which has an external coating providing waterproof protection.

Such a waterproof protection is very vulnerable to fracturing and in the case of the base, this is accentuated by any particular shape of the base.

Accordingly there is provided, according to this invention, a base in which the underneath outer edge is shaped so as to provide a curvature of substantial radius so as to diminish the potential for stress concentration hence fracturing of the protective coat.

Obviously changes to the radius can be provided to increase or diminish this effect but with a radius of perhaps at least 2 or 3 mms, there will be significant reduction in stress concentration.

While reference has been made to a planar base, and this having an outermost circular periphery, it is also of value in terms of moulding from a plastics material, to have an internal circular aperture co-axial with the external periphery.

One difficulty with the previous concept was that if the top of a box had the waterproof coating punctured, especially during installation of the mesh, and this was left overnight, then moisture, rain or the like could enter into the corrugated cardboard interface making the top of the box soft and losing significant advantage of the system.

In preference, the base is of planar shape both on a top surface and a bottom surface so as to reduce the possibility of water by reason of rain or dew gathering in any container like space and, therefore, affecting the quality of concrete that might later come into intimate contact with such water.

A further reason for the turret shape to be totally spaced above and apart from the base is to allow for concrete to extensively pass below the turret shape so that the turret shape and, therefore, the supported fabric is properly insulated from an external surface.

The shape in cross-section of the chair can either be rectangle, square, or circular or any combination of these and there can be variously one, two or more sets of apertures with upwardly open shapes.

BRIEF DESCRIPTION OF THE DRAWINGS

For a better understanding of this invention it will now be described with reference to preferred embodiments which shall be described with the assistance of drawings accompanying the specification and in which.

DETAILED DESCRIPTION OF THE INVENTION

Figure 1:
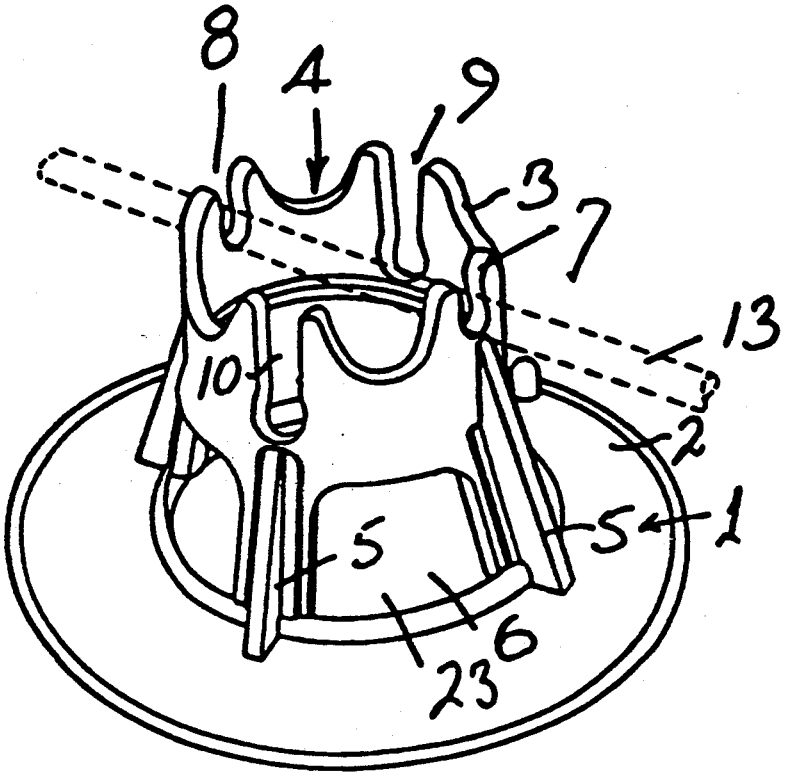
FIG. 1 is a perspective view of a chair according to a first embodiment.

Referring in detail to the drawings, it is to be emphasised that the purpose of the upwardly open slots in every case is to provide for an interengaging shape so that an appropriate steel rod comprising a part of the reinforcing fabric suitable for concrete foundations, such as a mesh of rods, will be firstly supported therein but more importantly so far as this invention is concerned interlock therein so that if the fabric is caused to lift, there will at least be a substantial force causing the chairs to also lift with the fabric and therefore more likely to stay interlocked therewith and located appropriately therewith.

To this end, there is provided in accordance with the first embodiment as disclosed in FIGS. 1, 2, 3 and 4, a chair 1 moulded by injection moulding from plastics material and which includes a lower most substantially horizontal base part 2 and a central upwardly extending turret or upper most open slot support part 3.

The central turret 3 is of frusto conical shape and has a central open core 4 and around a periphery of the turret shape, a plurality of slots defined between the edges of the wall forming the turret each slot being upwardly open and each of which is adapted to provide support in some manner and positive retaining location for steel rods useful for foundation in the application described.

The turret in each case is appropriately reinforced with side stays such as at 5 and has open parts such as at 6 adapted to ensure concrete will generally engulf and encompass all of the parts of the chair 1.

The feature of this invention however is that the respective gaps or upwardly open slots such as shown at 7 and 8 in the one case and 9 and 10 in the other are each shaped so as to provide for an interlocking effect with respect to any rods that are to be inserted therein. The respective gaps or slots 7, 8, 9 and 10 are aligned with respect to a common axis in the respective pairs and the common axis of each pair is in a crossing relationship to the common axis of the other pair as seen in FIG. 1.

The insertion in each case would be where the rod is horizontally oriented with respect to the orientation of each slot and such that the diameter of each rod is compatable to the width apart of the respective sides defining each respective slot.

Figure 2:
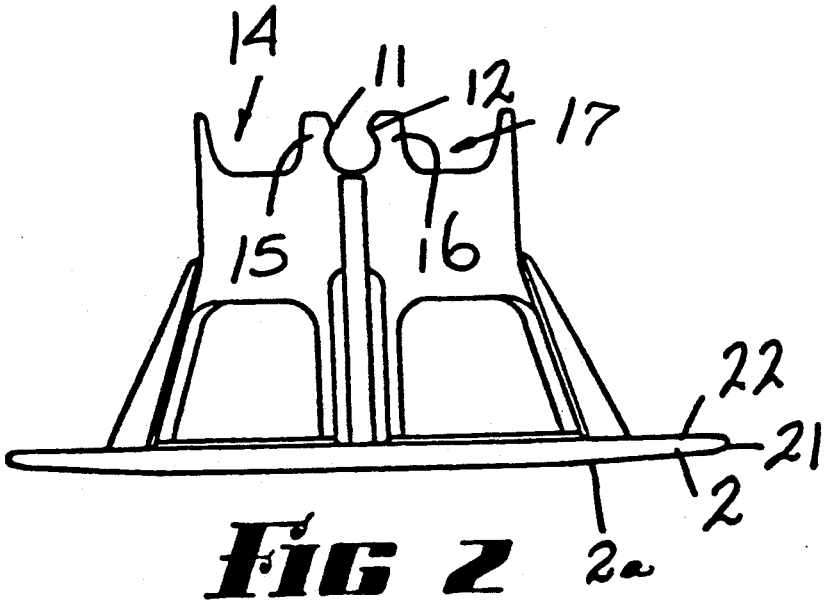
FIG. 2 is a side elevation in a first direction of the said first embodiment as shown in FIG. 1.

To this end therefore each of the slots has an upper part in which its sides are defined between edges of the wall of the turret such as is shown in FIG. 2 at 11 and 12 and there is a higher part which is narrower than a lower part forming an interference fit relative to the diameter of an appropriate steel shaft such as shown in FIG. 1 at 13. The lower part is of appropriate diameter to accommodate the diameter of an appropriate steel shaft 13 such that the shaft 13 will be held with negligible vertical freedom in the slot.

In other words, there is an interengaging interlocking effect at least to the extent necessary to allow for reasonably easy access through the narrow gap of the rod but thereafter retention of the rod with respect to the chair 1.

Figure 3:
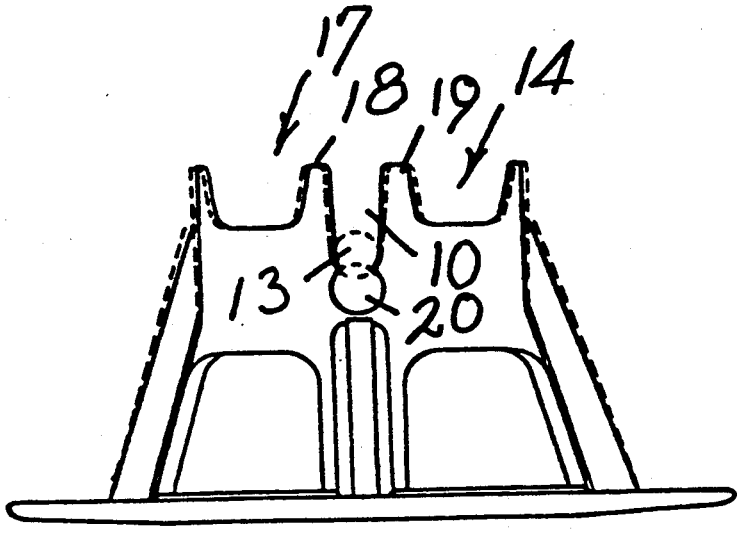
FIG. 3 is a side elevation of the said first embodiment as shown in FIG. 1 showing the view in side elevation in quadrature to that view shown in FIG. 2.
Figure 4:
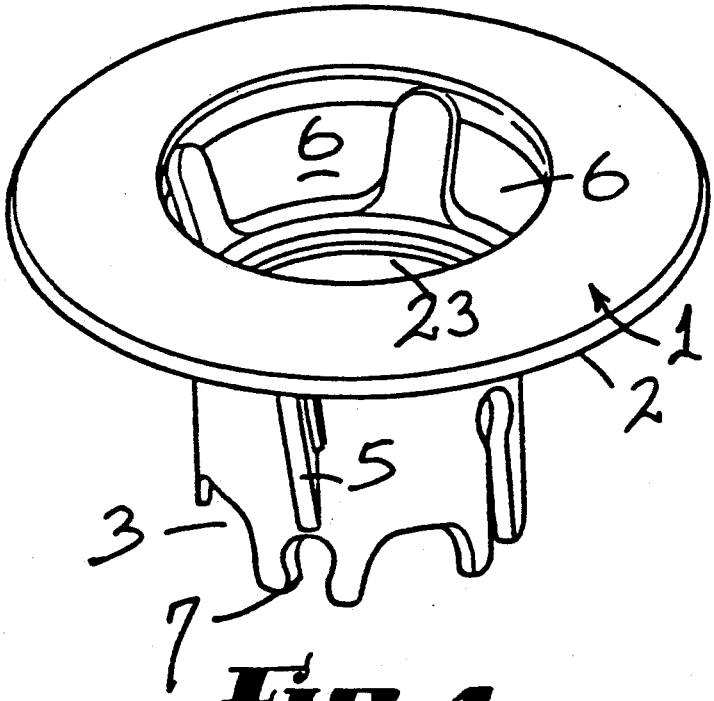
FIG. 4 is an underneath perspective view of the first embodiment as shown in FIGS. 1, 2 and 3.
Figure 5:
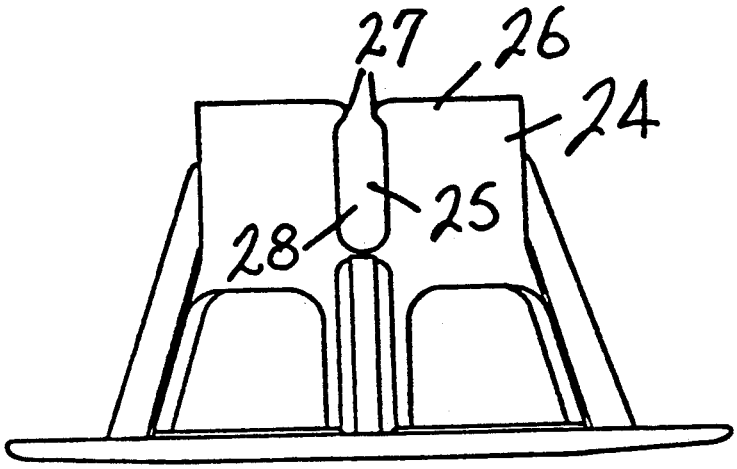
FIG. 5 is a side elevation of a second embodiment.

The gaps in the turrent 3 as are shown at 14 and 15 allow for more flexible movement of the sides of the slot as shown by reference to fingers 18 and 19 thereby defined and the relative extent of movement is shown perhaps more easily in FIG. 3 in which the gap 14 and the gap 15 allow for the movement as shown between the hard lines and the dotted lines of fingers 18 and 19 in respect of slot 10 where the rod 13 is being inserted thereinto and being expected to come to a settlement position within the broader defining shape at 20 which forms an offset part from the uppermost open mouth of slot 10. The offset part 20 is of a shape and adapted to engage and hold a reinforcement fabric rod with negligible vertical freedom relative to the chair.

In each case, there are oppositely located slots of equal shape and size the advantage of this being simply to provide for additional interlocking. One of the further difficulties relating to a chair of this type is the fact that the base 2 can in some instances when being pushed to a side, rise on one edge and can quite easily cause potential damage if it is resting on a relatively vulnerable underlying surface.

This is certainly the case if the underlying surface is a cardboard box as is the case in the application being considered, and to this end therefore the base 2 includes an underneath shape extending fully beneath any of the turret 3 and which defines a sphere the perimeter of which at 2*a* is a relatively large radius but not so large as to not ensure that the underneath side which is of substantially planar shape, provides a smooth transition from its lowermost face to its edges as shown at 21.

Furthermore, the upper surface of this base at 22 is shaped so as to generally shed water, and the middle of the base shown at 23 is open this providing firstly a convenient shape for manufacture of this article by injection moulding, the saving of plastics material for this purpose and finally the assistance of concrete so as to further potentially surround the material to increase its strength.

This then describes the first embodiment.

The second embodiment illustrates an alternate shape for the deeper slot the chair being shown at 24 and the slot at 25.

All of the upper end of the turret at 26 can be caused to be deflected when a rod is caused to pass between the narrower walls 27 at the uppermost open mouth of slot 25 and thereafter when in the broader part at 28 while there is some freedom for the rod to rise and fall, it would realistically never escape from entrapment in this shape and once again therefore the chair 24 will follow and be held in reasonable attachment to the fabric. Alternatively, the reinforcement fabric mesh of steel rods may inherently be laid in overlapping relationship with several reinforcement rods being laid on top of one another in parallel relationship, wherein slot 25 will enable a plurality of the reinforcement fabric rods to be captured and held with negligible vertical freedom relative to the chair 24.

Figure 6:
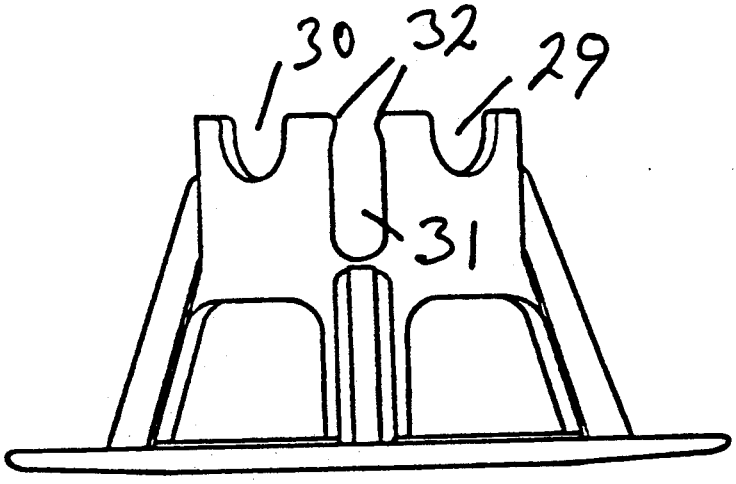
FIG. 6 is a side elevation of a third embodiment.
Figure 7:
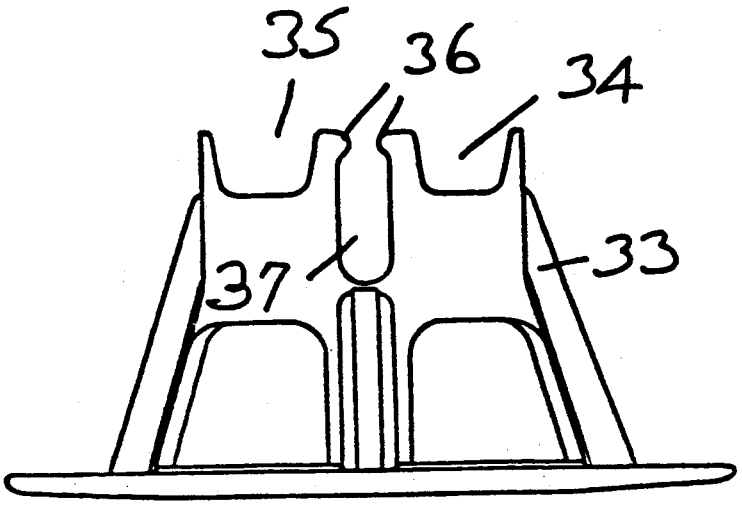
FIG. 7 is a side elevation of a fourth embodiment.

In FIG. 6, the third embodiment, the only variation to the second embodiment is that there are gaps at 29 and 30 on the one side and equivalent slots on the other side so that the major gap 31 with its narrowest part uppermost at 32 can provide for a greater resilient freedom mainly because of the lack of material caused by the gaps 29 and 30. The fourth embodiment in FIG. 7 is very much equivalent to the second embodiment shown in FIG. 6 except for a variation in shape of the gaps.

Accordingly the turret 33 includes gaps 34 and 35 allowing for significant freedom of distortion by the closer walls 36 of the slot 37.

Figure 8:
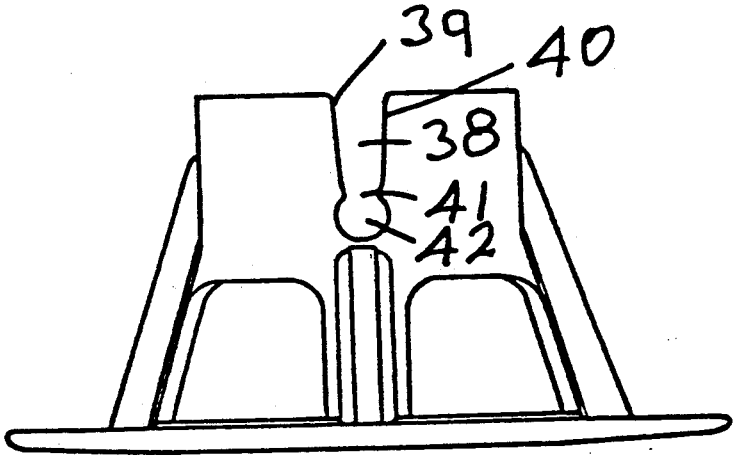
FIG. 8 is a side elevation of a fifth embodiment.

An alternative to this is the further embodiment shown in FIG. 8 in which the slot 38 includes substantially narrowing sides 39 and 40 at the bottom of which is firstly a narrowest part 41 offset from the uppermost open mouth of slot 38, and finally a broadening part 42 forming an offset part from the mouth adapted to interlock with the fabric at a lowermost position so as to hold a reinforcement fabric rod with negligible vertical freedom.

Figure 9:
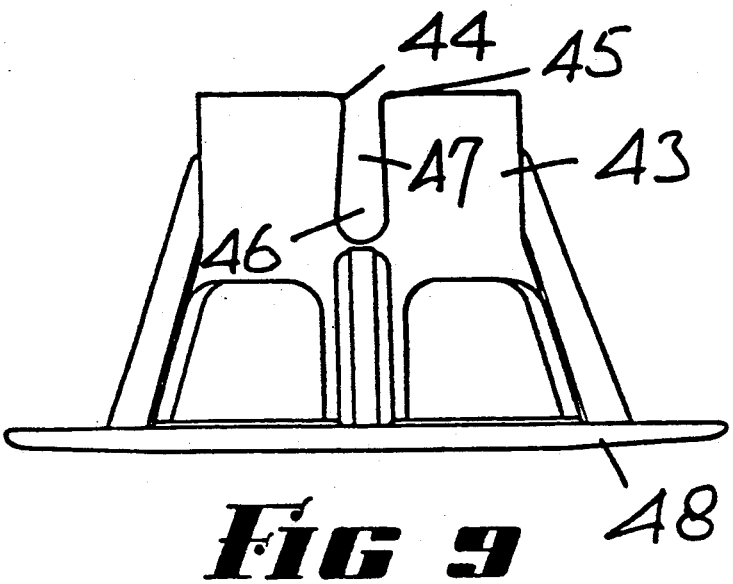
FIG. 9 is a side elevation of a sixth embodiment.

A further variation of these shapes is shown in FIG. 9 in which the narrowest part of the chair 43 is at 44 and 45 and there is a gradual widening after this to the lowermost part 46 which is widest at the otherwise upwardly open slot 47.

In each of these cases the base such as at 48 includes the equivalent shape and the turret is otherwise the same as in the first embodiment.

Figure 10:
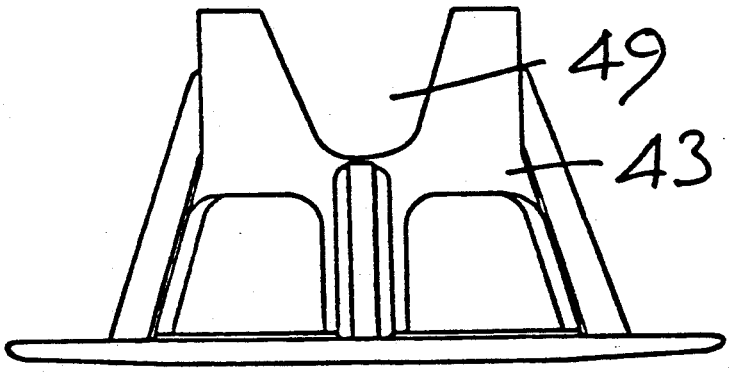
FIG. 10 is the quadrature view of the embodiment as shown in FIG. 9 namely the sixth embodiment.

In FIG. 10, this shows the quadrature gap shape at 49 to that slot 47 shown in FIG. 9 so that this allows for ample freedom of movement of the uppermost part of the turret shape.

Figure 11:
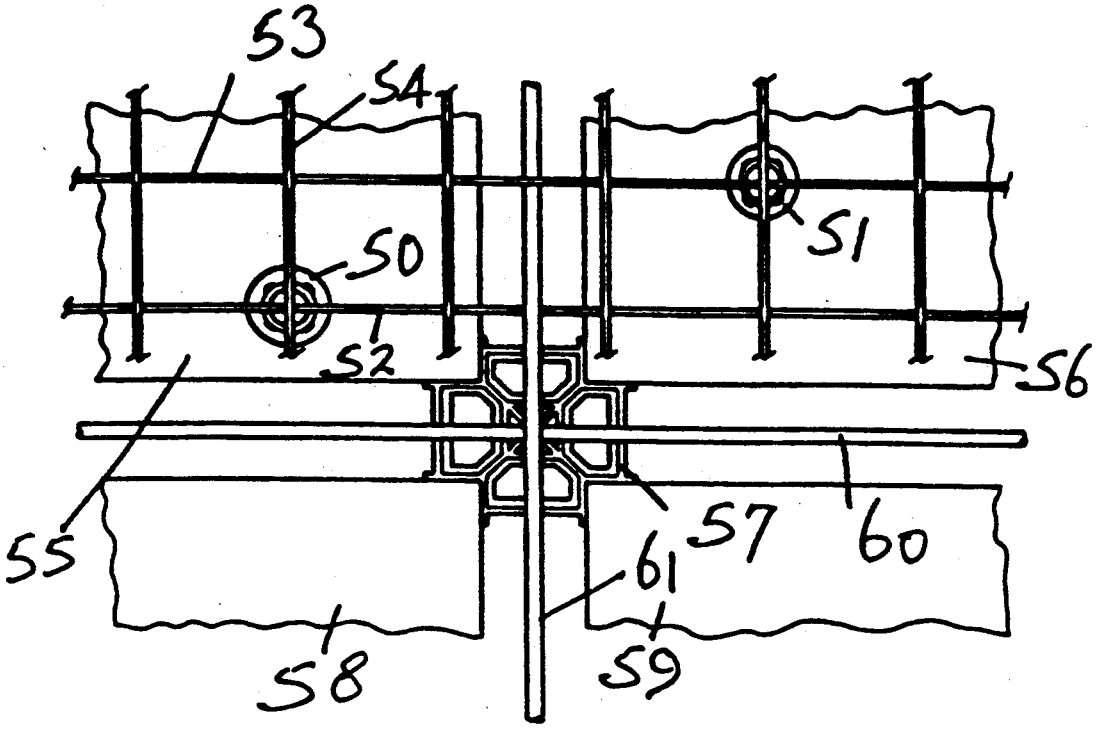
FIG. 11 is a plan view shown in schematic outline of an arrangement in which any one of the chairs of the previous embodiments is shown in position supporting an appropriate fabric.

Now referring to FIGS. 11, this shows broadly in schematic manner, a chair at 50 and at 51 providing support for a fabric mesh 52 which comprises welded together steel bars which however are located one above the other so that the cross bars shown at 53 are lower than the orthoganally orientated bars at 54.

Each of the chairs as shown in 11 are located on a cardboard box at 55 and 56 which in turn are kept spaced apart by a spacer 57 located so as to capture the respective corner of the boxes 55, 56, 58 and 59 which in turn supports fabric at 60 and 61.

Figure 12:
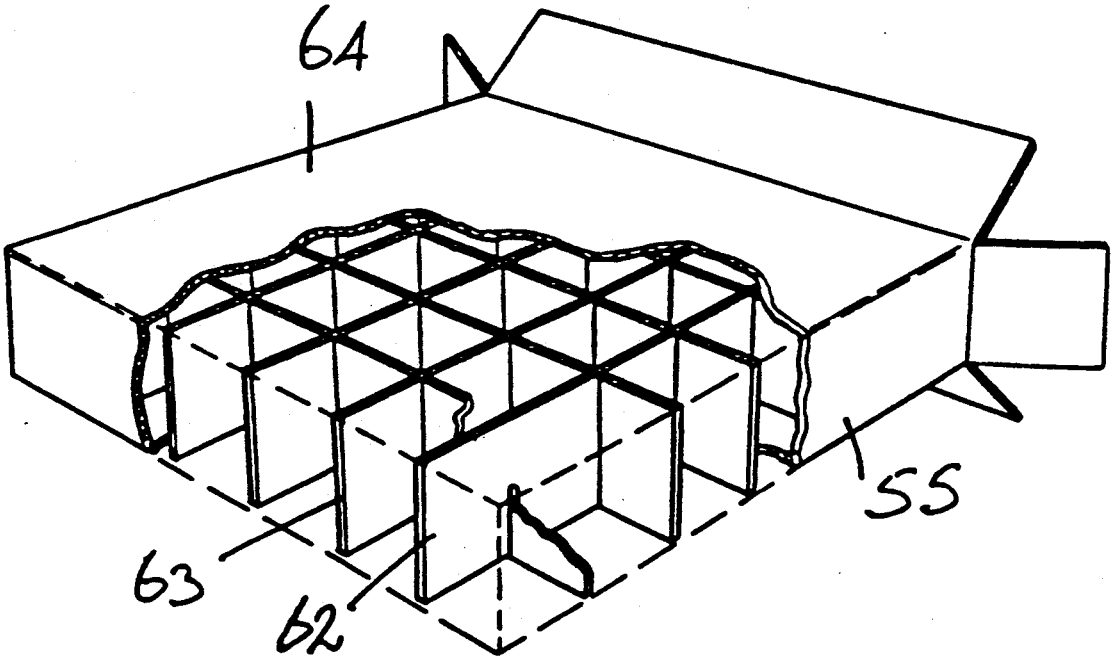
FIG. 12 illustrates the type of lost formwork comprising a cardboard box being comprised of a plurality of internal egg crate type divisions of corrugated cardboard.
Figure 13:
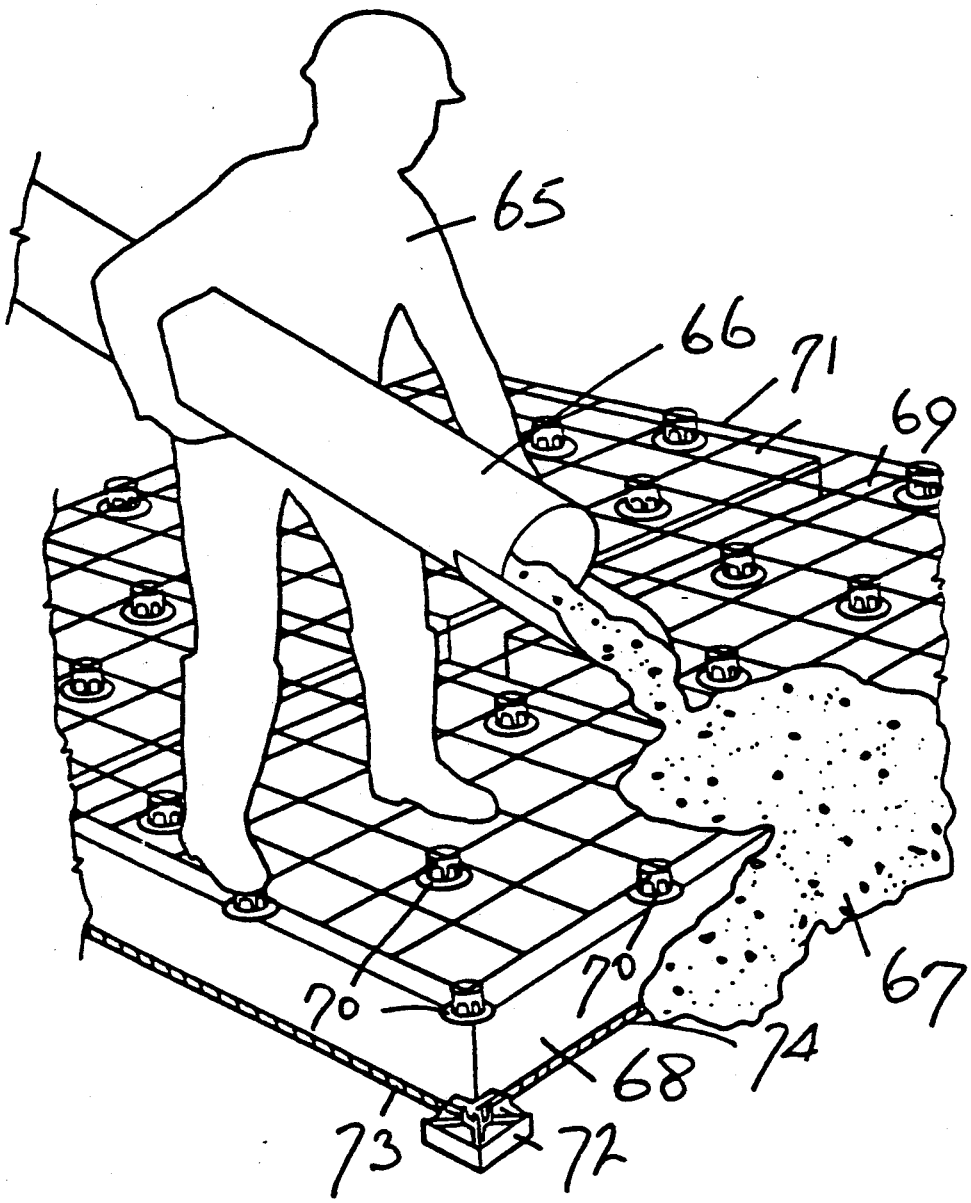
FIG. 13 illustrates the way in which the chairs are used showing in outline a worker in the steps of pouring concrete where the chairs are supporting fabric on lost formwork as shown in FIG. 12.

The cardboard box as shown typically at 55 is shown in more detail and in part cut-away cross-section in FIG. 12 in which there are a number of egg crate internal spaces shown at typically 62 and 63 from which it will be seen that the upper surface 64 will be relatively vulnerable to concentrated pressures.

Such boxes are coated with a moisture protection coat but if a sharp point enters through this, the cardboard beneath this is vulnerable to moisture perhaps arising from the concrete itself or from being left overnight and being subject to rain or dew and the like.

Finally there is a perspective view of the pouring procedure being used and accordingly there is a person 65 holding a concrete directing conduit 66 which is directing concrete 67 over the respective lost formwork cardboard boxes 68, 69 and the like and there are a number of chairs 70 each of which support fabric in the manner described the fabric being shown typically at 71.

The boxes are held apart by spaces 72 which in turn are located and are supporting reinforcing rods 73 and 74.

This then describes the preferred embodiments from which it will be seen that there is provided a very substantially effective method of interlocking steel fabric with respect to a chair.

Figure 14:
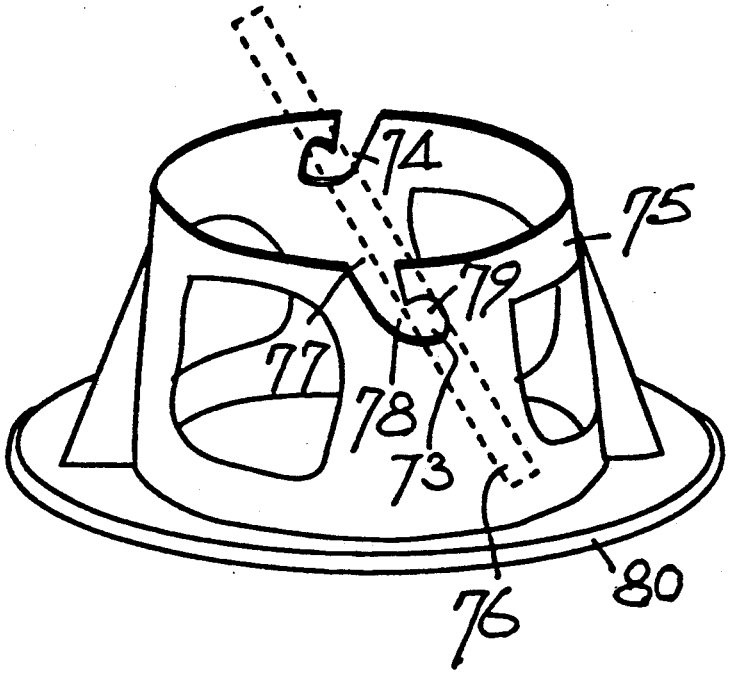

As an example of the way in which the slots can be changed in shape so as to assist in the interlocking effect, there is a further drawing attached hereto namely FIG. 14 which shows a further embodiment being a perspective view of the embodiment and being shown in schematic outline especially so as to simply show the shape of the slots shown at 73 and 74 the chair itself being shown at 75 and the rod being shown at 76.

Each slot such as at 73 is of shape including a widest uppermost shape at 77 narrowing to a narrowest position at 78 but including a strong offset orientation so that the broadest aperture at 79 is substantially offset to the aperture position 77.

In this way, the chair 75 to be dislodged not only needs substantial force but especially needs a sideways rotation effect which would be highly unlikely in the circumstances of the problem situation.

The chair 75 includes as with all of the other cases, an appropriate horizontal base 80 which is appropriately shaped at an underneath sides to provide for a minimum ensnarement of the underlying cardboard surface.

I claim:

1. A support chair for supporting reinforcements for foundations comprising the combination of a planar base supporting a plurality of side stays attached to a central turret; the central turret comprising at least four upwardly open slots, with at least two of said upwardly open slots adapted to interengage with gripping effect on a reinforcement rod of circular cross section, the at least two upwardly open slots each having a plurality of upper edges presenting a smaller opening than a portion of the respective slot lying adjacent said upper edges; two of the slots being long slots and two of the slots having a short slots, the two long slots having a common axis located below an upper common axis for the two short slots, wherein said two long slots include two straight sides connecting a circular bottom portion adapted to support at least one reinforcement bar therein, wherein the width between said two straight sides is narrower than the adjacent circular bottom portion such that a reinforcement bar will cause deflection of the edges of said slot upon insertion into said circular bottom portion such that said at least on reinforcement bar will be held with negligible vertical freedom relative to said chair, and said two short slots are adapted to support at least one reinforcement rod above and in crossing relationship to any wherein said short support said reinforcement rod supported within the two long slots; each slot being located just above a respective side stay; each of said short slots being positioned between said long slots, such that no two like slots are adjacent one another; and said upper edges of said at least two slots comprising a plurality of fingers being formed in the central turret at locations adjacent said slots, these fingers deflecting outwardly from the center of each slot when the reinforcement rod is inserted into the respective slots.

2. A support chair as in claim 1 further characterized in that said two short slots having said common axis being substantially the same shape and size so as to provide equivalent interengaging effect with respect to said reinforcement rods positioned therein.

3. A support chair as in claim 1 in which the chair is comprised of a resilient plastics material.

4. A support chair as in claim 1 wherein the base of the chair includes a lowermost shape having a surface shape following the perimeter of a sphere.

5. A support chair as in claim 1 wherein each of the upwardly open slots has an uppermost open mouth and includes a shape providing for an offset part from the uppermost open mouth, said offset part being of a shape and adapted to engage and hold said reinforcement rod to resist vertical movement of said rod.

6. A support chair as in preceding claim 1 wherein the turret is a wall of frusto conical shape the upper edge of which defines said at least two upwardly open slots with one of the slots being located at a diametrically opposite position with respect to the frusto conical shape to the other of the slots, each of the slots having a part that is narrower positioned higher than a lower part.

7. A support chair as in preceding claim 6 wherein there are four upwardly open slots defined within the upper edge of the turret shape, two of which are diametrically aligned with respect to the frusto conical shape in a first direction which is orthogonally aligned to the diametrically aligned other two slots, and each pair of said diametrically aligned slots adapted to support at least one selected reinforcement rod at a selected height.

8. A support chair as in claim 1 wherein each upwardly open slot is defined by a wall part of the turret and said turret also include upwardly open gaps adjacent each side of said slots wherein the wall part of the turret forms said fingers at the upper edges of each slot between an adjacent gap.

9. A support chair as in preceding claim 1 wherein said base extends fully beneath any uppermost turret area.

10. A support chair as in claim 1 wherein the turret is a wall of frusto conical shape the upper edge of which defines said four upwardly open slots, each of the slots being located in diametrically opposing position to one of the other slots with respect to the frusto conical shape of the turret wall, each of the slots having a part that is narrower positioned higher than a lower part, and each two opposing slots having a shape by which two reinforcement rods of identical circular cross sectional shape will pass only with interference fit through the narrower part and thereafter be held with negligible vertical freedom relative to the chair.

11. A support chair as in claim 1 wherein the turret is a wall of frusto conical shape the upper edge of which defines said four upwardly open slots, each of the slots being located in diametrically opposing position to one of the other slots with respect to the frusto conical shape of the turret wall, each of the slots having a part that is narrower positioned higher than a lower part, and each two opposing slots having a shape by which three reinforcement rods of identical circular cross sectional shape will pass only with interference fit through the narrower part and thereafter be held with negligible vertical freedom relative to the chair.

12. A support chair as in claim 1, further characterized in that reinforcement rods positioned in the long slots are at 90° to a reinforcement rod position in said short slots.

13. A support chair as in claim 1, further characterized in that said two long slots having said common axis having a wider opening at an upper part of the respective slot and being substantially the same shape and size to provide equivalent interengaging effect with respect to a reinforcement rod positioned therein.

14. In combination, a support chair for supporting reinforcements for foundations having a planar base supporting a plurality of side stays attached to a central turret comprising at least four upwardly open slots; at least two of the upwardly open slots being adapted to interengage with gripping effect on reinforcement rod of a circular cross section;

the said at least two upwardly open slots each having a plurality of upper edges having a smaller opening than a lower portion of the respective slot;

two of the slots having a long slot and two of the slots having a short slot, the two long slots having a common axis located below an upper common axis for the two short slots, wherein at least one reinforcement rod will sit in the two long slots, and at least one other reinforcement rod will sit in the two short slots above and in crossing relation to the rod positioned in the two long slots;

each slot being located just above a respective side stay;

said slots being arranged such that no two like slots are adjacent one another;

and wherein the upper edges of said at least two slots comprise a plurality of fingers being formed in the central turret at locations adjacent said slots, these fingers deflecting outwardly from the center of each slot when a reinforcement rod is inserted into the respective slots;

at least one reinforcement rod extending through and interengaged with at least two of the upwardly open slots of the chair, and a broadly extending base comprising a plurality of boxes supported on a broad surface in spaced relationship wherein a plurality of said support chairs are positioned on said plurality of boxes and engage said reinforcement rods for support thereof above said boxes.

15. The combination as defined in claim 14, wherein reinforcement rod extending through and interengaged with two of the upwardly open slots of the chair.

16. The combination as defined in claim 14, wherein said base providing a broad surface is a cardboard box structure.

17. A support chair for supporting reinforcement comprising the combination of a planar base supporting a plurality of side stays attached to a central turret; the central turret comprising at least four upwardly open slots and four upwardly open gaps; with the upwardly open slots adapted to support at least one reinforcement rod of circular cross section; two of the slots have a long slot and two of the slots have a short slot, the long slots having a common axis located below an upper common axis for the two short slots wherein at least one reinforcement bar will sit in the two long slots and at least one other reinforcement rod will sit in the two short slots above and in crossing relationship to the rod in the two long slots; each slot being located just above a respective side stay; each gap having one short slot on one side and one long slot on the other, such that no two like slots or gaps are adjacent one another; and a plurality of fingers being formed in the central turrent where at the upper edges of each slot and respective gap meet, these fingers deflect inward towards the center of each gap when a rod is inserted into the respective slots.

* * * * *